US005379745A

United States Patent [19]

Vogel et al.

[11] Patent Number: 5,379,745

[45] Date of Patent: Jan. 10, 1995

[54] IGNITION SYSTEM FOR INTERNAL COMBUSTION ENGINES WITH HIGH-TENSION SWITCHES

[75] Inventors: Manfred Vogel, Ditzingen-Heimerdingen; Werner Herden, Gerlingen, both of Germany

[73] Assignee: Robert Bosch GmbH, Stuttgart, Germany

[21] Appl. No.: 142,311

[22] PCT Filed: Apr. 14, 1992

[86] PCT No.: PCT/DE92/00305

§ 371 Date: Nov. 16, 1993

§ 102(e) Date: Nov. 16, 1993

[87] PCT Pub. No.: WO92/21875

PCT Pub. Date: Oct. 12, 1992

[30] Foreign Application Priority Data

May 31, 1991 [DE] Germany ..... 4117808

[51] Int. Cl.[6] ..... F02P 3/12

[52] U.S. Cl. ..... 123/655; 123/635; 123/656; 123/654

[58] Field of Search ..... 123/655, 635, 643, 654, 123/656

[56] References Cited

U.S. PATENT DOCUMENTS

| | | | |
|---|---|---|---|
| 2,643,284 | 6/1953 | Putnam | 123/655 |
| 3,406,672 | 10/1968 | Phillips et al. | 123/656 |
| 3,753,428 | 8/1973 | Phillips | 123/654 |
| 3,900,017 | 8/1975 | Collins | 123/655 |
| 4,083,347 | 4/1978 | Grather et al. | 123/635 |
| 4,203,403 | 5/1980 | Fujii et al. | 123/656 |
| 4,411,247 | 10/1983 | Kunita et al. | 123/655 |
| 4,463,744 | 8/1984 | Tanaka et al. | 123/643 |
| 5,044,349 | 9/1991 | Benedikt et al. | 123/655 |
| 5,265,580 | 11/1993 | Vogel et al. | 123/655 |

FOREIGN PATENT DOCUMENTS

| | | |
|---|---|---|
| 0200010 | 11/1986 | European Pat. Off. . |
| 3731393 | 4/1989 | Germany . |
| 61-164073 | 7/1986 | Japan . |
| 61-164074 | 7/1986 | Japan . |
| 61-182469 | 8/1986 | Japan . |
| 62-070665 | 4/1987 | Japan . |
| 62-121863 | 6/1987 | Japan . |
| 1083853 | 3/1989 | Japan . |
| 9107014 | 5/1991 | WIPO . |

*Primary Examiner*—Raymond A. Nelli
*Attorney, Agent, or Firm*—Michael J. Striker

[57] ABSTRACT

An ignition system for internal combustion engines, has a plurality of spark plugs, an ignition coil provided for the spark plugs and having a secondary circuit, at least one trigger diode cascade formed as a high voltage semiconductor switch and connected in the secondary circuit of the ignition coil prior to each of the spark plugs so as to change suddenly from a blocking state to a conducting state at a preselected voltage for generating ignition sparks, and a capacitor connected parallel to the secondary winding of the ignition coil between the ignition coil and the trigger diode cascade.

9 Claims, 2 Drawing Sheets

IGNITION SYSTEM FOR INTERNAL COMBUSTION ENGINES WITH HIGH-TENSION SWITCHES

BACKGROUND OF THE INVENTION

The present invention relates to an ignition system for internal combustion engines with high-tension switches.

More particularly, it relates to an ignition system in which at least one trigger diode cascade, as high-voltage semiconductor switch, is connected in a secondary circuit of each ignition coil prior to each spark plug and changes suddenly from a blocking state to a conducting state at a preselected voltage for generating ignition sparks.

The ignition system mentioned above uses high-voltage switches which are arranged on the secondary side, preferably in the spark plug terminal. Trigger diode cascades are used as high-voltage switching elements. A stack of 10 to 50 trigger diodes is used depending on the electric strength of an individual trigger diode and depending on the desired breakover voltage. With such a high-voltage semiconductor switch which changes suddenly from the blocking state to the conducting state, it is possible practically to eliminate the influences of shunts at the spark plug. Because of their self-capacitance, long ignition lines subsequent to the trigger diode cascade negatively affect the steepening effect of the trigger diode cascade. For this reason, the high-voltage semiconductor switch is preferably arranged in the spark plug terminal. In contrast, relatively long lines prior to the trigger diode cascade have an advantageous influence because, due to their self-capacitance, they suddenly release the stored energy as the high-voltage semiconductor switch becomes conductive. When such semiconductor switching elements are used in double ignition coils, the division of voltage on the secondary side makes it necessary to keep the breakover voltage of the high-voltage semiconductor switches low enough so that this breakover voltage is achieved in every case. However, this has the disadvantage that there is hardly any steepening effect when the breakover voltage is clearly below 11 kV.

SUMMARY OF THE INVENTION

Accordingly, it is an object of the present invention to provide an ignition system for internal combustion engines with high-tension switches, which avoids the disadvantages of the prior art.

In keeping with these objects and with others which will become apparent hereinafter, one feature of the present invention resides, briefly stated, in an ignition system in which four internal combustion engines, in which a capacitor is connected parallel to the secondary circuit of the ignition coil between the ignition coil and the trigger diode cascade.

When the ignition system is designed in accordance with the present invention, it has the advantage over the prior art that, regardless of the installation location of the high-voltage semiconductor switch in the form of a trigger diode cascade, an additional capacitor is arranged between the ignition coil and the high-voltage semiconductor switch on the secondary side parallel to the secondary winding so that a sufficiently high jump in voltage is achieved at the spark plug even with low system capacitance.

Advantageous further developments and improvements of the ignition system indicated above are made possible by further steps. It is particularly advantageous to use a ceramic capacitor which is dependent on temperature in such a way that the steepening effect is only increased during a cold start and the capacitance of the capacitor decreases sharply during operation due to heating. The increased energy requirement of the ignition system and thus the increased loading of the ignition coil by the capacitor are accordingly limited to the very brief cold start phase.

A further advantage consists in the use of a capacitor in double ignition coils. In this case, only one capacitor need be installed in spite of the allocation of two spark plugs to a coil. This economizes on material and accordingly reduces cost.

Finally, it is advantageous that the capacitor can be switched on or off optionally. Thus, this steepening effect is only enhanced when required by the system, e.g. during a cold start, particularly in capacitors without sufficient temperature dependence.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
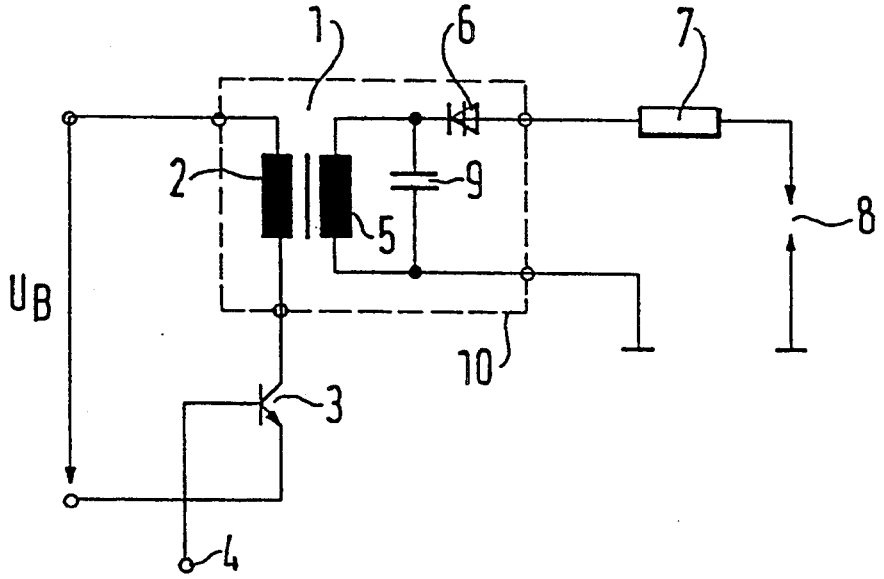
FIG. 1 shows the basic construction of an ignition system.

FIG. 1 shows the basic construction of an ignition system with an ignition coil 1 whose primary winding 2 is connected to a power supply $U_B$, e.g. to the battery of a motor vehicle, not shown, via an ignition transistor 3. The ignition transistor 3 is driven in a known manner via a control terminal 4. The secondary winding 5 is connected to ground potential on one side and with the spark plug 8 on the other side via a trigger diode cascade 6, which acts as a high-voltage semiconductor switch, and an anti-interference resistor 7. The ignition system shown in FIG. 1 operates in the following manner. By turning off the current flowing through the primary winding 2 of the ignition coil 1 by means of the ignition transistor 3, a voltage is induced in the secondary winding 5 at ignition. When the breakover voltage predetermined by the trigger diode cascade 6 is reached, this causes a switching-through to the spark plug 8, which leads to the triggering of the ignition spark. A capacitor 9 arranged on the secondary side parallel to the secondary winding is charged as long as the trigger diode cascade 6 blocks. This capacitance is released when the trigger diode cascade 6 switches through and thus leads to an increase in the steepening effect. In FIG. 1, the trigger diode cascade 6 and the capacitor 9 are arranged in the housing 10 of the ignition coil. The housing is symbolized in this figure by a dashed line.

Figure 2:
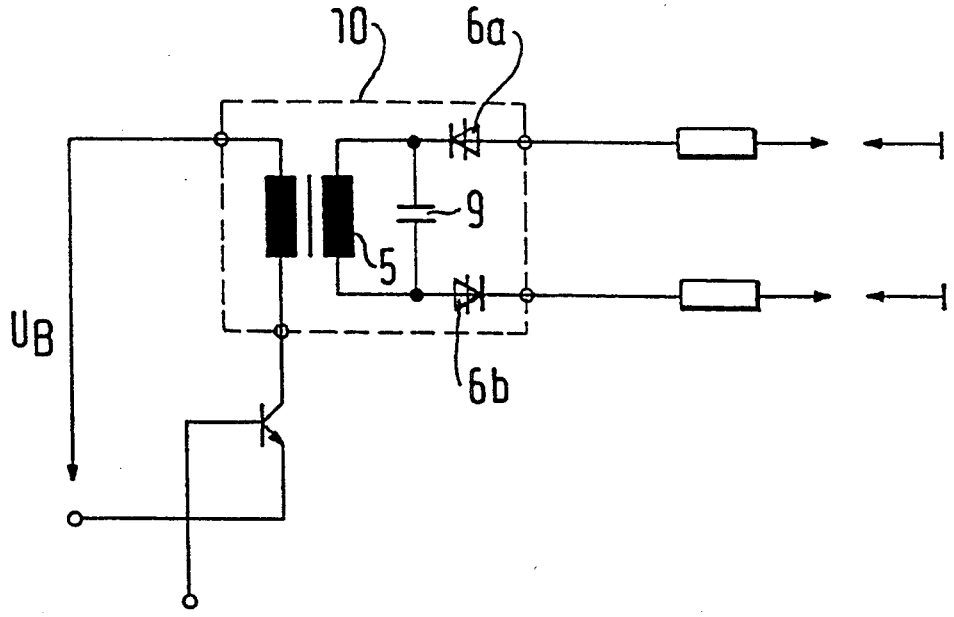
FIG. 2 shows an ignition system with double ignition coils.

FIG. 2 shows a construction similar to FIG. 1. However, in this case a double ignition coil is used. In this construction, a trigger diode cascade 6 is associated with each end of the ignition coil; these trigger diode cascades 6 are distinguished by a and b respectively. The trigger diode cascades are associated with the coil ends with different polarity. The capacitor 9 for increasing the steepening effect is connected in parallel with the secondary winding 5 prior to the trigger diode cascades 6*a* and 6*b*. As in FIG. 1, the trigger diode cascades and the capacitor are also arranged in the ignition coil housing 10 in this embodiment form.

Figure 3A:
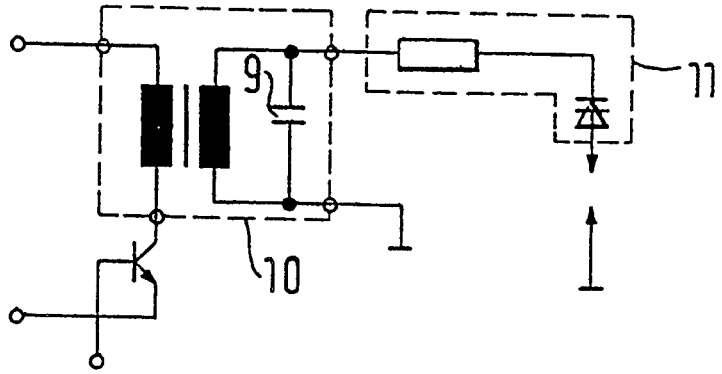
FIGS. 3*a* and 3*b* show possible installation locations for the high-voltage semiconductor switch.
Figure 3B:
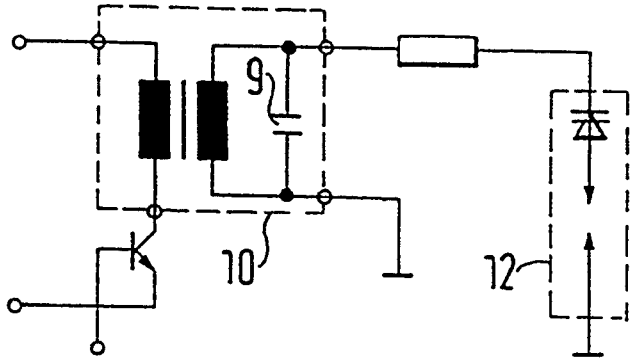

FIGS. 3*a* and 3*b* show a construction similar to that in FIG. 1. The capacitor 9 is arranged in the ignition coil housing in both cases. In contrast to FIG. 1, the trigger diode cascade is arranged in the spark plug terminal 11 in FIG. 3*a* and in the spark plug 12 in FIG. 3*b*. This has the advantage that the self-capacitance of the ignition line can be utilized for the steepening effect.

Figure 4:
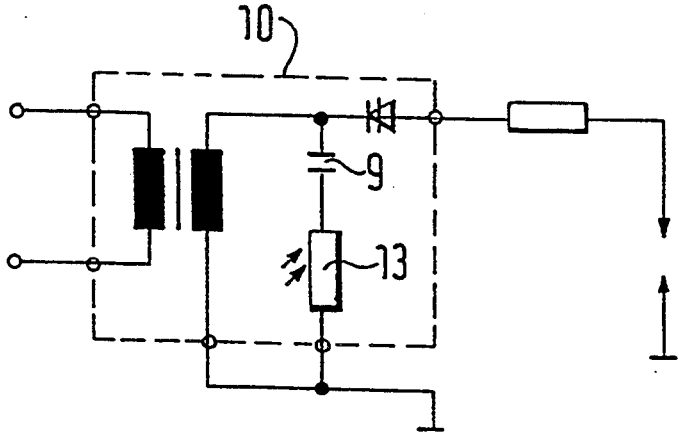
FIG. 4 shows an ignition system with a capacitor which can be switched off on the secondary side.

FIG. 4 likewise shows a construction similar to FIG. 1. In this case, however, a high-voltage switch 13 is arranged parallel to the secondary winding 5 in series with the capacitor 9. This high-voltage switch can be triggered by light, for example. This has the advantage that the effect of the capacitor 9 can be switched on or off optionally. Thus, the capacitor 9 is switched on during a cold start, for example, so as to ensure a reliable ignition spark even if the spark plugs are extensively fouled.

For ignition systems with rotating distribution it is advantageous for the purpose of achieving a high steepening effect to install the capacitor 9 in the ignition coil housing and to install the high-voltage trigger diode, for example, in the rotor of the distributor, in the center connector of the distributor, in the ignition line between the ignition coil and distributor or directly in the ignition coil.

It will be understood that each of the elements described above, or two or more together, may also find a useful application in other types of constructions differing from the types described above.

While the invention has been illustrated and described as embodied in an ignition system for internal combustion engines with high-tension switches, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An ignition system for internal combustion engines, comprising a plurality of spark plugs; an ignition coil provided for said spark plugs and having a secondary circuit; at least one trigger diode cascade formed as a high voltage semiconductor switch and connected in said secondary circuit of said ignition coil prior to each of said spark plugs so as to change suddenly from a blocking state to a conducting state at a preselected voltage for generating ignition sparks; and a capacitor connected parallel to said secondary winding of said ignition coil between said ignition coil and said trigger diode cascade.

2. An ignition system as defined in claim 1; and further comprising an ignition coil housing, said capacitor being arranged in said ignition coil housing.

3. An ignition system as defined in claim 1, wherein said capacitor is arranged immediately adjacent to said ignition coil.

4. An ignition system as defined in claim 1, wherein said capacitor is a ceramic capacitor which responds to temperature and has a reduced capacitance in a heated state.

5. An ignition system as defined in claim 1; and further comprising an ignition coil housing, said ignition coil being formed as a double ignition coil, said trigger diode cascade being associated with each coil end, said capacitor being located between said trigger diode cascades.

6. An ignition system as defined in claim 5, wherein said trigger diode cascades have different polarities, said trigger diode cascades with different polarities are associated with different, Ones of said coil ends.

7. An ignition system as defined in claim 1, wherein said capacitor is selectively switched on or off.

8. An ignition system as defined in claim 7; and further comprising a switch for selectable switching on an offset capacitor, said switch being formed as a high-voltage switch which is triggerable by light and connected in series with said capacitor.

9. An ignition system as defined in claim 1, wherein said capacitor is formed so as to be switched on during cold starting.

* * * * *